US007301428B2

(12) United States Patent
Suzuki et al.

(10) Patent No.: US 7,301,428 B2
(45) Date of Patent: Nov. 27, 2007

(54) PRINTED CIRCUIT BOARD TRANSFORMER

(75) Inventors: Koji Suzuki, Kakuda (JP); Kenichi Takebayashi, Kakuda (JP); Seiichiro Abe, Kakuda (JP); Takeshi Chiba, Kakuda (JP); Tomoya Katanoda, Ebina (JP)

(73) Assignee: Keihin Corporation, Tokyo (JP)

( * ) Notice: Subject to any disclaimer, the term of this patent is extended or adjusted under 35 U.S.C. 154(b) by 0 days.

(21) Appl. No.: 11/504,650

(22) Filed: Aug. 16, 2006

(65) Prior Publication Data

US 2007/0046410 A1 Mar. 1, 2007

(30) Foreign Application Priority Data

Aug. 23, 2005 (JP) ..... 2005-240847

(51) Int. Cl.
*H01F 27/28* (2006.01)

(52) U.S. Cl. ..... 336/180

(58) Field of Classification Search ..... 336/65, 336/69, 180–186, 206–208
See application file for complete search history.

(56) References Cited

U.S. PATENT DOCUMENTS 4,518,941 A * 5/1985 Harada ..... 336/69
6,236,298 B1 * 5/2001 Chen ..... 336/208
6,549,431 B2 * 4/2003 Odell et al. ..... 363/21.12
6,762,946 B2 * 7/2004 Odell et al. ..... 363/21.12

FOREIGN PATENT DOCUMENTS

JP 4-94713 U 8/1992
JP 2000-299233 A 10/2000

* cited by examiner

*Primary Examiner*—Tuyen T. Nguyen
(74) *Attorney, Agent, or Firm*—Westerman, Hattori, Daniels & Adrian, LLP.

(57) ABSTRACT

An object of the invention is to provide a PCB transformer having plural output channels, which can suppress a voltage fluctuation in each output channel to supply a stable output without the need for a larger body, even though an input load fluctuates. The PCB transformer include, a core having a core axis, a first layer including a winding for each input line separately wound around said core as plural input coils spaced from each other along the core axis, and a second layer including a winding for an output line corresponding to each output channel separately wound on said first layer as plural output coils spaced from each other along the core axis. One of the input coils and one of the output coils are disposed in one of winding regions defined along the core axis. In each the winding region, one coil having a narrower width of the input coil or the output coil is disposed within a width of another coil along said core axis.

7 Claims, 6 Drawing Sheets

PRINTED CIRCUIT BOARD TRANSFORMER

BACKGROUND OF THE INVENTION

1. Field of the Invention

This invention relates to a transformer for being mounted on a printed circuit board (hereinafter, it is referred as "PCB transformer".), and particularly to a multi-channel insulated power PCB transformer having plural output channels.

2. Description of the Related Art

When an electronic device comprises a plurality of control circuits, each control circuit is individually supplied with its electric power from the power circuit. Such power circuit includes a multi-channel insulated power transformer which can produce a plurality of independent power from a single power source. The multi-channel insulated power transformer has, typically, coil structures comprising input (primary) coils for being supplied with the electric power from the outside of the device and output (secondary) coils, which is independent each other, for being connected to the control circuit. For the purpose of downsizing electric devices, there has been a demand to make a smaller insulated power transformer having plural output channels for being mounted on a circuit board, i.e. PCB transformer. In such a small power transformer, as compared with a larger power transformer, it is more important to supply highly accurate output power to each output channel to stabilize a drive efficiency.

For example, Japanese Utility Model Kokai No. 04-94713 discloses coil structures in a PCB transformer. An input coil comprises a first half coil and a second half coil, and a plurality of output coils corresponding to each channel are inserted between these input coils that face each other in a radial direction. With respect to the coil structures, the reference mentions that a magnetic flux formed by two input coils can be efficiently coupled to output coils so as to provide higher drive efficiency to the PCB transformer.

For example, Japanese Patent Kokai No. 2000-299233 also discloses coil structures in a PCB transformer. An input coil for one input line is divided into two input coils that face each other in a radial direction and plurality of output coils corresponding to each output channel are inserted between these two input coils. One of the windings in each output coil is mutually disposed on a core along its long axis. The output winding of each output coil is wound by non-inductive winding, such as bifilar-winding or trifilar-winding. According to this structures, a rectification smoothing circuit of each output channel can be suppressed in its peak value. Such power circuit can be smaller and more stable. Further, regulation characteristics are improved in an output voltage of each output channel.

In typicall power circuits, the input coil has a larger number of windings than the output coil corresponding to each output channel so that the output (secondary) side is a higher voltage than the input (primary) side. When the transformer has more output channels, the total number of output coil windings corresponding to output channels becomes larger. As mentioned in the above references, if the input coil is divided into two coils, output coils may not be accommodated within the width of the input coils. In this case, for example, a width of the output coil may be decreased by forming the output coils with double layers piled in a radial direction. However, the body of the transformer becomes larger, as the output coils become thicker. Such large body is not preferred in view of an accommodation space for mounting the transformer on a circuit board.

Further, since the relative position against the input coil is quite different in each output coil, a load variation in the input coil provides a different effect to output coils. In this case, the voltage variation should be individually compensated in each output channel. As a result, the power circuits become larger.

SUMMARY OF THE INVENTION

The present invention has been made to solve the problem as mentioned above. Objects of the invention are to provide a PCB transformer, which can suppress a voltage fluctuation in each output channel to supply a stable output without the need for a larger body, even though an input load fluctuates.

The PCB transformer having plural output channels comprises a core having a core axis, a first layer for input coils and a second layer for output coils. The first layer includes windings for input lines separately wound around the core as input coils spaced from each other along the core axis. The second layer includes windings for output lines corresponding to output channels separately wound on the first layer as plural output coils spaced from each other along the core axis. One of the input coils and one of the output coils are disposed in one of a plurality of winding regions defined along the core axis. In each of the plurality of winding regions, one coil having a narrower width of the input coil or the output coil is disposed within a width of another coil along the core axis.

According to the present invention, a magnetic coupling can be enhanced between the input coils and the output coils without the need for a larger body of the transformer, especially a larger height along a radial direction of the core. That is, a magnetic leakage flux can be reduced to obtain high driving efficiency as a power transformer. Further, even if a power load fluctuates in the input coil, low magnetic leakage flux can suppress the voltage fluctuation in each output channel to provide stable output.

DETAILED DESCRIPTION OF THE INVENTION

In a PCB transformer according to the present invention, an input winding for an input (primary) line is separately wound around a core as plural input coils spaced from each other along a longitudinal direction of the core. That is, these input coils are spaced from each other along the core axis by "winding in a division space". An output winding for an output (secondary) line corresponding to one output channel is wound as an output coil with correspondence to one input coil wound by "winding with a division space". In this coil structure, it is easy to control a magnetic field produced by the input coil, and a magnetic coupling can be enhanced between the input and output coils. Further, a magnetic leakage flux can be reduced to stabilize outputs of the transformer. The transformer can become smaller since the input coil is not divided to several layers.

Embodiments of a PCB transformer according to the present invention will be described hereinafter in detail with reference to FIGS. 1 to 4.

The PCB transformer 1 has a rectangular body. Its longitudinal direction is defined as a Z-axis direction. The X-axis and Y-axis are defined along two mutually perpendicular sides in a cross section of the PCB transformer 1 being perpendicular in the Z-axis.

Figure 1:
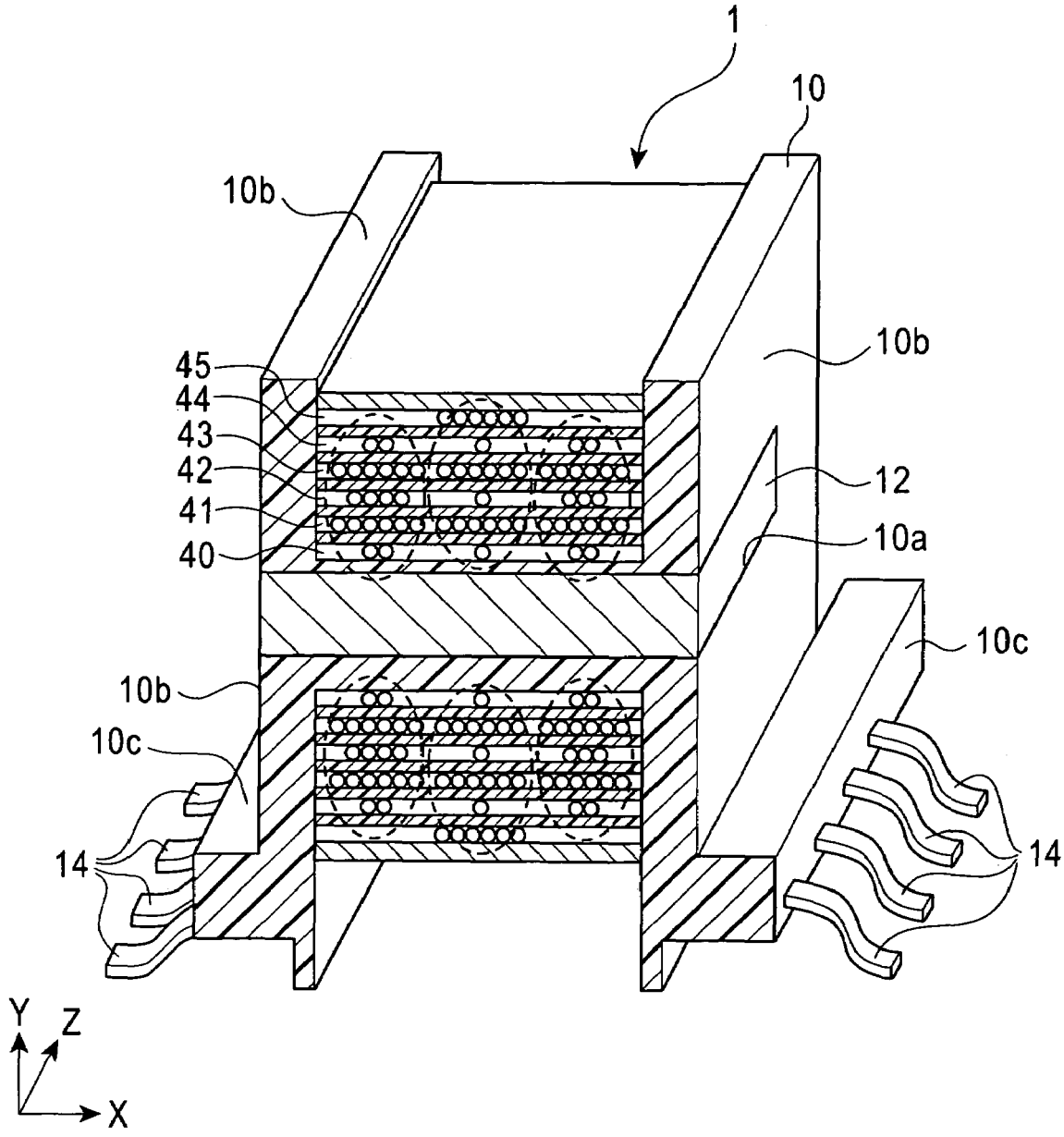
FIG. 1 is a perspective and cross-sectional view illustrating a PCB transformer according to one embodiment of the present invention.
Figure 2:
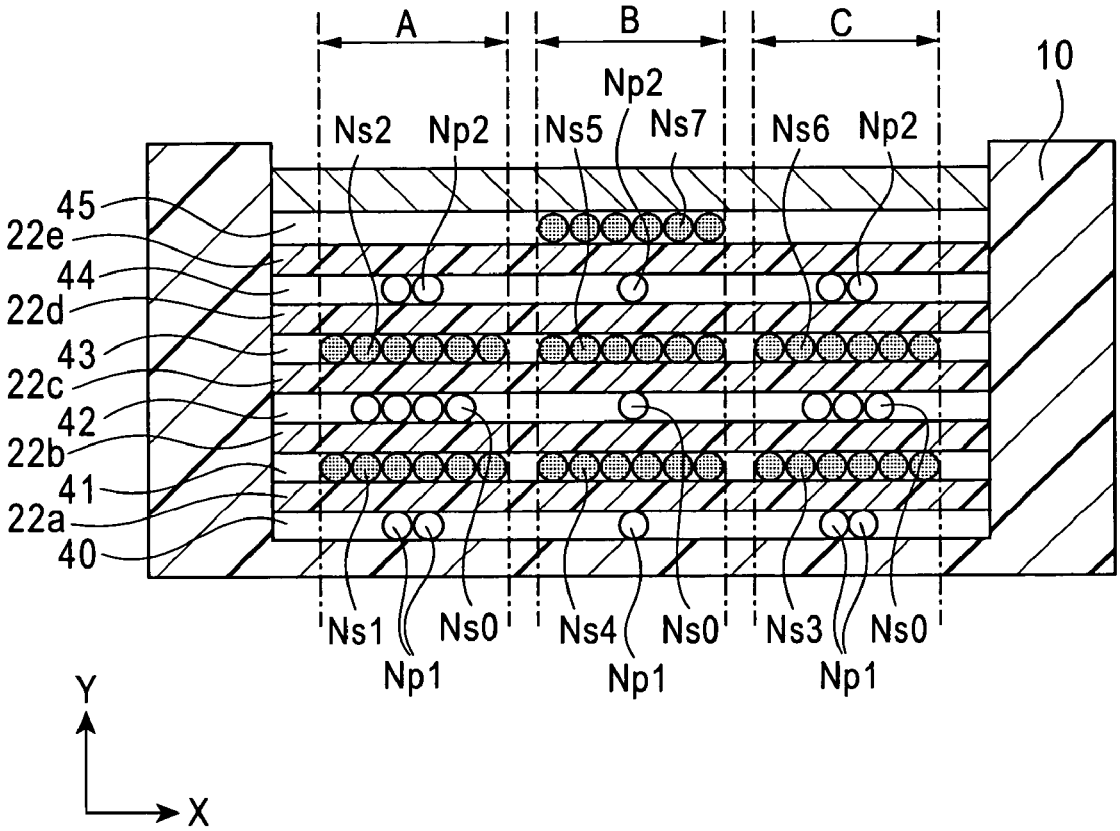
FIG. 2 is a fragmentary cross-sectional view illustrating the PCB transformer according to one embodiment of the present invention.
Figure 3:
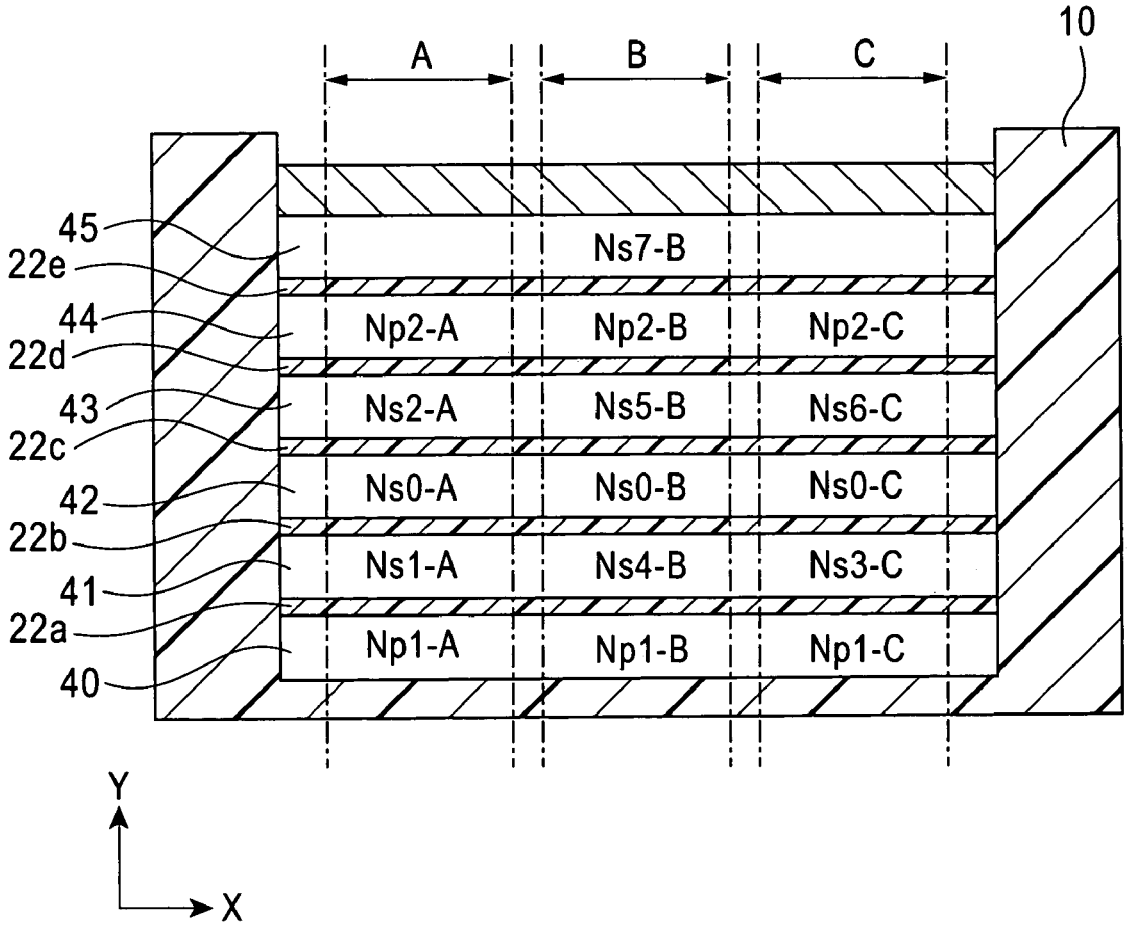
FIG. 3 is a fragmentary cross-sectional schematic view illustrating the PCB transformer according to one embodiment of the present invention.

As illustrated in FIG. 1, a bobbin 10 is made from insulation materials such as plastics and covers four faces other than two opposed mutually sides (the two sides located in both ends of the X-axis) in six faces of a rectangular core 12 made from a core material, such as a ferrite. The rectangular core 12 is accommodated without a space into a center through hole 10*a*, which has an approximately rectangular shape in a section, in a center portion of the bobbin 10. A pair of rectangular plate flanges 10*b* faced each other and extends radially in a Y-Z plane from edges of both aperture ends of the center through hole 10*a*. A protrusion 10*c* is formed along a Y-axis edge of the flange 10*b* toward the outside. The protrusion 10*c* supports plural metal reed terminals 14 for connecting each of the coils to a printed circuit board.

As illustrated in FIGS. 1 to 4, a non-controlling input (primary) winding Np1 is separately wound in the most inner part of bobbin 10 within three winding regions A, B and C spaced from each other along the X-axis. Hereinafter, a coil formed by winding a winding U within a winding region L is referred to a "coil U-L". For example, a coil of Np1-A is formed by winding a winding Np1 within the winding region A. The coils of Np1-B and Np1-C are formed by winding the same winding Np1 within winding regions B and C, respectively. A first coil layer 40 includes coils Np1-A, Np1-B and Np1-C around a core 12. The winding regions A, B and C have the same width along the X-axis corresponding to the widest width in coils wound within these winding regions. All coils around the bobbin 10 are wound so as to be disposed within the width of either one of the winding regions A, B and C.

As described below, a magnetic field density increases in the winding region B by an influence of magnetic fields produced by the input coil within the two winding regions A and C located in both sides of the winding region B. It is, therefore, preferred that the number of winding of the input coil Np1 in the winding region B is less than the number of winding coils in the winding regions A and C.

An insulation sheet 22*a* is disposed on the first coil layer 40 to cover the coils Np1-A, Np1-B and Np1-C to prevent a short circuit with coils thereon.

The output (secondary) windings Ns1, Ns4 and Ns3 corresponding to the first, fourth and third channels are wound within the winding regions A, B and C, respectively, on the insulation sheet 22*a* to compose a second coil layer 41. Each output winding Ns1, Ns4 and Ns3 is wound with a high density winding within the winding regions A, B and C, respectively, as coils Ns1-A, Ns4-B and Ns3-C so that each of the output windings are arranged side by side with high density and no space therebetween along the X-axis direction.

When the coil Ns1-A has a wider width along the X-axis than the coil Np1-A, the coil Np1-A is accommodated in the inside of the width of the coil Ns1-A. On the other hand, the Ns1-A coil is accommodated in the inside along the width of the Np1-A coil, when the Ns1-A coil has a smaller width along the X-axis than the Np1-A coil.

Preferably, the Ns1-A and Np1-A coils are disposed within the same winding region A, so that these coils have the same center position along the width direction. More preferably, the Ns1-A coil and Np1-A coil are disposed so that the same center position of these coils corresponds to the center position of the winding region A.

Similarly, when the Ns4-B coil has a larger width than the Np1-B coil, the Np1-B coil is accommodated in the inside of the width of the Ns4-B coil. Also, the Ns4-B coil is accommodated in the inside of the width of the Np1-B coil, when the Ns4-B coil has a smaller width along the X-axis than the Np1-B coil.

Preferably, the Ns4-B and Np1-B coils are disposed within the same winding region C so that the center positions along the width direction of these coils are located at the same position. More preferably, the Ns4-B and Np1-B coils are disposed so that the center positions along the width direction of these coils correspond to a center position of the width direction of the winding region B.

Further, when the Ns3-C coil has a larger width than the Np1-C coil, the Np1-C coil is accommodated in the inside of the width of the Ns3-C coil. Also, the Ns3-C coil is accommodated in the inside of the width of the Np1-C coil, when the Ns3-C coil has a smaller width along the X-axis than the Np1-C coil.

Preferably, the Ns3-C and Np1-C coils are disposed within the same winding region C so that the center positions along the width direction of these coils are located at the same position. More preferably, the Ns3-C and Np1-C coils are disposed so that the center positions along the width direction of these coils correspond to a center position of the width direction of the winding region C.

As mentioned above, the first coil layer 40 including the input winding Np1 makes a set with the second coil layer 41 including the output windings Ns1, Ns4 and Ns3. One coil included in the first coil layer 40 and one coil included in the second coil layer 41 are accommodated in the same winding region selected from winding regions on the core 10. Typically, Np1-A, Np1-B and Np1-C coils are wound with the Np1 winding with two turns, one turn and two turns, respectively. Also, Ns1-A, Ns4-B and Ns3-C coils are wound with six turns with the Ns1, Ns4 and Ns3 windings, respectively.

Further, an insulation sheet 22*b* is disposed on the second coil layer 41 to cover surfaces of Ns1-A, Ns4-B and Ns3-C coils to prevent a short circuit with coils thereon.

Figure 4:
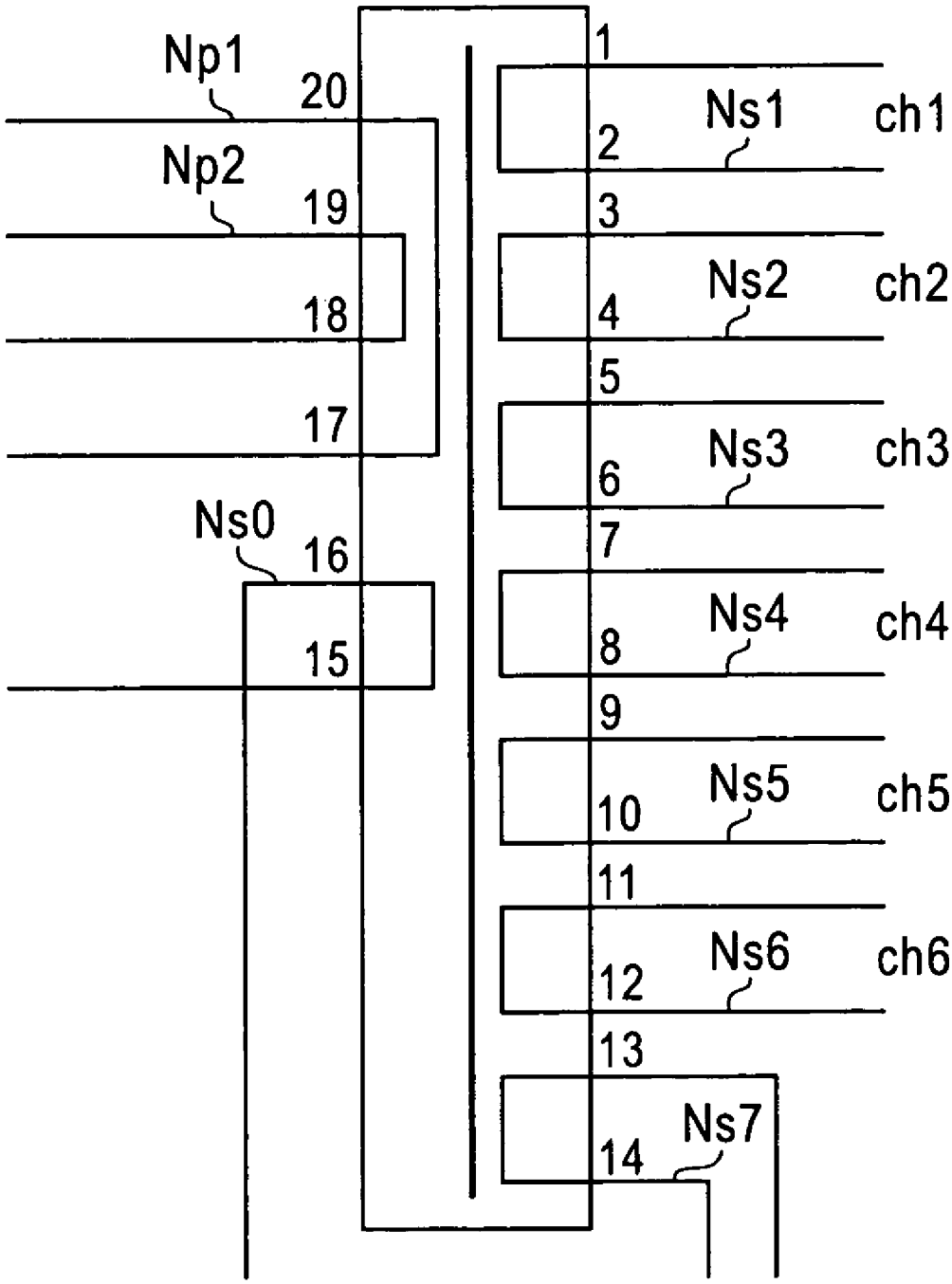
FIG. 4 is a circuit diagram in the PCB transformer according to one embodiment of the present invention.

As illustrated in FIG. 4, when the transformer 1 has a controlling input (feedback) winding Ns0 which does not depend on the non-controlling input winding Np1, the controlling input winding Ns0 is wound on the insulation sheet 22*b*. The voltage in windings of Ns1 to Ns7 can be controlled by a voltage produced in the controlling input winding Ns0. For the feedback controll, the Ns1 to Ns7 windings should be coupled more firmly with Ns1 through a magnetic flux. In detail, the controlling winding Ns0 is separately wound in three winding regions A, B and C spaced from each other. The coils Ns0-A, Ns0-B and Ns0-C are wound within the winding regions A, B and C to compose a third coil layer 42.

An insulation sheet 22*c* is disposed on the third coil layer 42 to cover surfaces of Ns0-A, Ns0-B and Ns0-C coils to prevent a short circuit with coils thereon.

The output windings Ns2, Ns5 and Ns6 for the second, fifth and sixth output channels are added to output windings in the second coil layer 41. The output windings Ns2, Ns5 and Ns6 are wound within the winding regions A, B and C, respectively, on the insulation sheet 22*c* to compose the fourth coil layer 43 so that one turn of these windings is arranged side by side in high density along the longitude direction of the core within each winding region.

When the Ns2-A coil has a larger width than the Ns0-A coil, the Ns0-A coil is accommodated in the inside of the width of the Ns2-A coil. On the other hand, the Ns2-A coil is accommodated in the inside along the width of the Ns0-A coil, when the Ns2-A coil has a smaller width than the Ns0-A coil.

Preferably, the Ns0-A and Ns2-A coils are disposed within the same winding region A so that the center positions of these coils along the width direction are located at the same position. More preferably, the Ns0-A and Ns2-A coils are disposed so that the center positions of these coils along the width direction correspond to a center position of the winding region A along the width direction Similarly, when the Ns5-B coil has a larger width than the Ns0-B coil, the Ns0-B coil coil is accommodated in the inside of the width of the Ns5-B coil. Also, the Ns5-B coil is accommodated in the inside along the width of the Ns0-B coil, when the Ns5-B coil has a smaller width than the Ns0-B coil.

Preferably, the Ns5-B and Ns0-B coils are disposed within the same winding region B so that the center positions along the width direction of these coils are located at the same position. More preferably, the Ns5-B and Ns0-B coils are disposed so that the center positions along the width direction of these coils correspond to a center position of the width direction of the winding region B.

Further, when the Ns6-C coil has a larger width than the Ns0-C coil, the Ns0-C coil is accommodated in the inside of the width of the Ns6-C coil. Also, the Ns6-C is accommodated in the inside along the width of the Ns0-C coil, when the Ns6-C coil has a smaller width than the Ns0-C coil.

Preferably, the Ns6-C and Ns0-C coils are disposed within the same winding region C so that the center positions along the width direction of these coils are located at the same position. More preferably, the Ns6-C and Ns0-C coils are disposed so that the center positions along the width direction of these coils correspond to a center position of the width direction of the winding region C.

The third coil layer 42 including the input coil winding Ns0 makes a set with the fourth coil layer 43 including the output coil windings Ns2, Ns5 and Ns6. One coil included in the third coil layer 42 and one coil included in the fourth coil layer 43 are disposed in one of winding regions A, B and C so that these coils face each other.

As described below, a magnetic flux density is relatively high in the-winding region B because of an influence of a magnetic flux produced by the input coils in the winding regions A and C located on both sides of the winding region B. Preferably, the number of windings in the input winding Ns0 within the winding region B is less than the number of windings within the winding regions A and C. Typically, the Ns0-A, Ns0-B and Ns0-C coils include four turns, one turn and three turns of Ns0 winding, respectively. The Ns2-A, Ns5-B and Ns6-C coils include six turns of Ns2, Ns5 and Ns6 windings, respectively.

An insulation sheet 22*d* is disposed on the fourth coil layer 43 to cover surfaces of the Ns2-A, Ns5-B and Ns6-C coils to prevent a short circuit with coils thereon.

The second non-controlling input winding Np2 is an input (primary) winding independent of the non-controlling input winding Np1 and is wound on the insulation sheet 22*d*. Specifically, the non-controlling input winding Np2 is separately wound within three winding regions A, B and C spaced from each other along the X-axis. That is, Np2-A, Np2-B and Np2-C coils are formed in the winding regions A, B and C to compose the fifth coil layer 44. Preferably, the Np2-A, Np2-B and Np2-C coils are, respectively, disposed within the winding regions A, B and C so that the center positions along the width direction of these coils are located at the same position. The Ns2-A, Ns5-B and Ns6-C coils include four turns, one turn and three turns of Ns2 winding, respectively.

An insulation sheet 22*e* is disposed on the fifth coil layer 44 to cover Np2-A, Np2-B and Np2-C coils.

Finally, the controlling (feedback) output winding Ns7 corresponding to the controlling (feedback) input winding Ns0 is wound on the insulation sheet 22*e* within the winding region B of the center to compose the Ns7-B coil. The sixth coil layer 45 includes only the Ns7-B coil. Preferably, the center position of the Ns7-B coil in the width direction is the center position of the winding region B. A poly-imide tape is wound on the Ns7-B coil.

Characteristics of a magnetic field produced by the above coil structure in the PCB transformer according to the present invention will be described.

Figure 5:
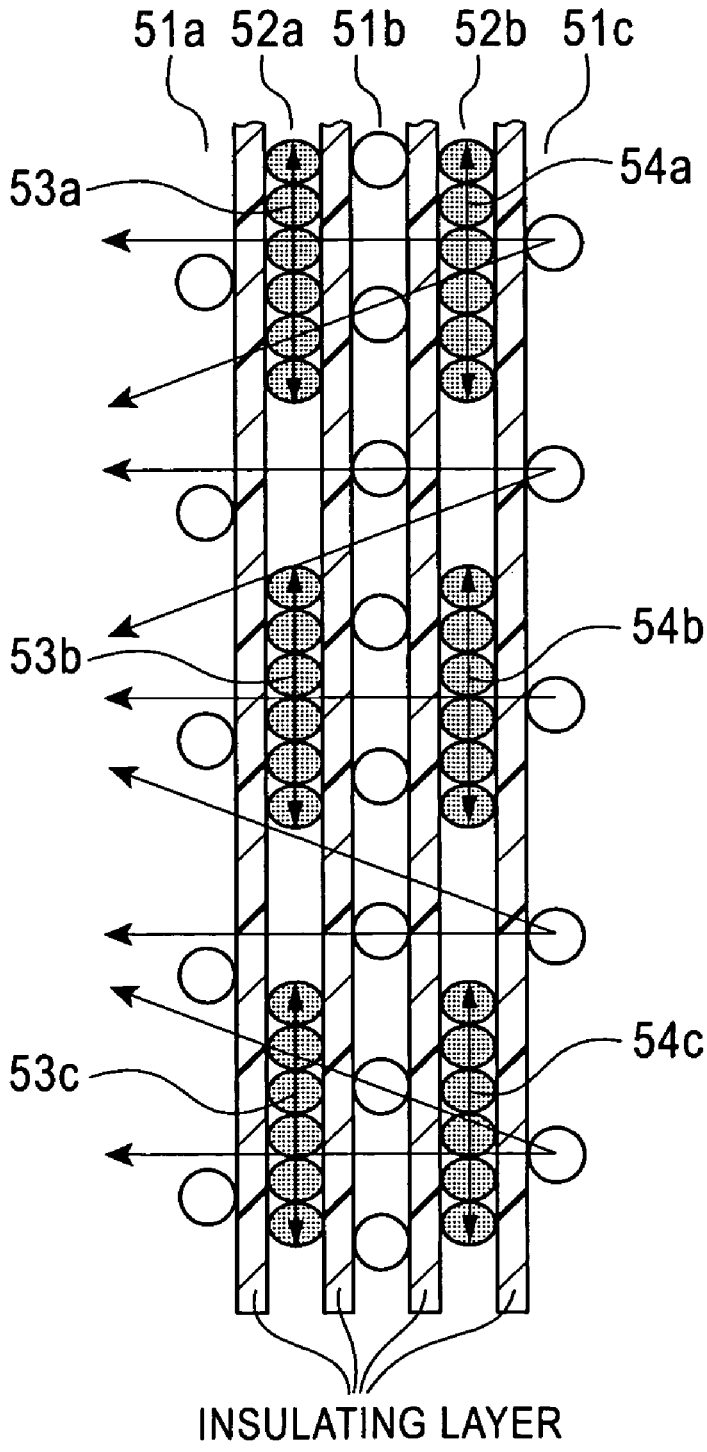
FIG. 5 PRIOR ART
FIG. 5 is a schematic view illustrating coil structures in a PCB transformer according to prior art.

As shown in FIG. 5, in the coil structures of the conventional transformer, input (primary) windings are disposed with an equal interval in input coil layers 51*a*, 51*b* and 51*c*. On the other hand, output (secondary) windings 53*a*, 53*b*, 53*c*, 54*a*, 54*b* and 54*c* in output coil layers 52*a* and 52*b* are disposed with an equal intervals to insulate each other. A magnetic flux (magnetic energy) produced in the input coil layers 51*a*, 51*b* and 51*c* non-uniformly passes through output coil layers 52*a* and 52*b*. Especially, the magnetic flux passing through coils 53*b* and 54*b* located in the center of the transformer is larger than the magnetic flux passing through coils 53*a*, 54*a*, 53*c* and 54*c* located in the ends of the transformer. That is, the "coupling degree" is high in coils 53*b* and 54*b*. The dispersion of the coupling degree causes a fluctuation of output voltage in output channels.

Figure 6:
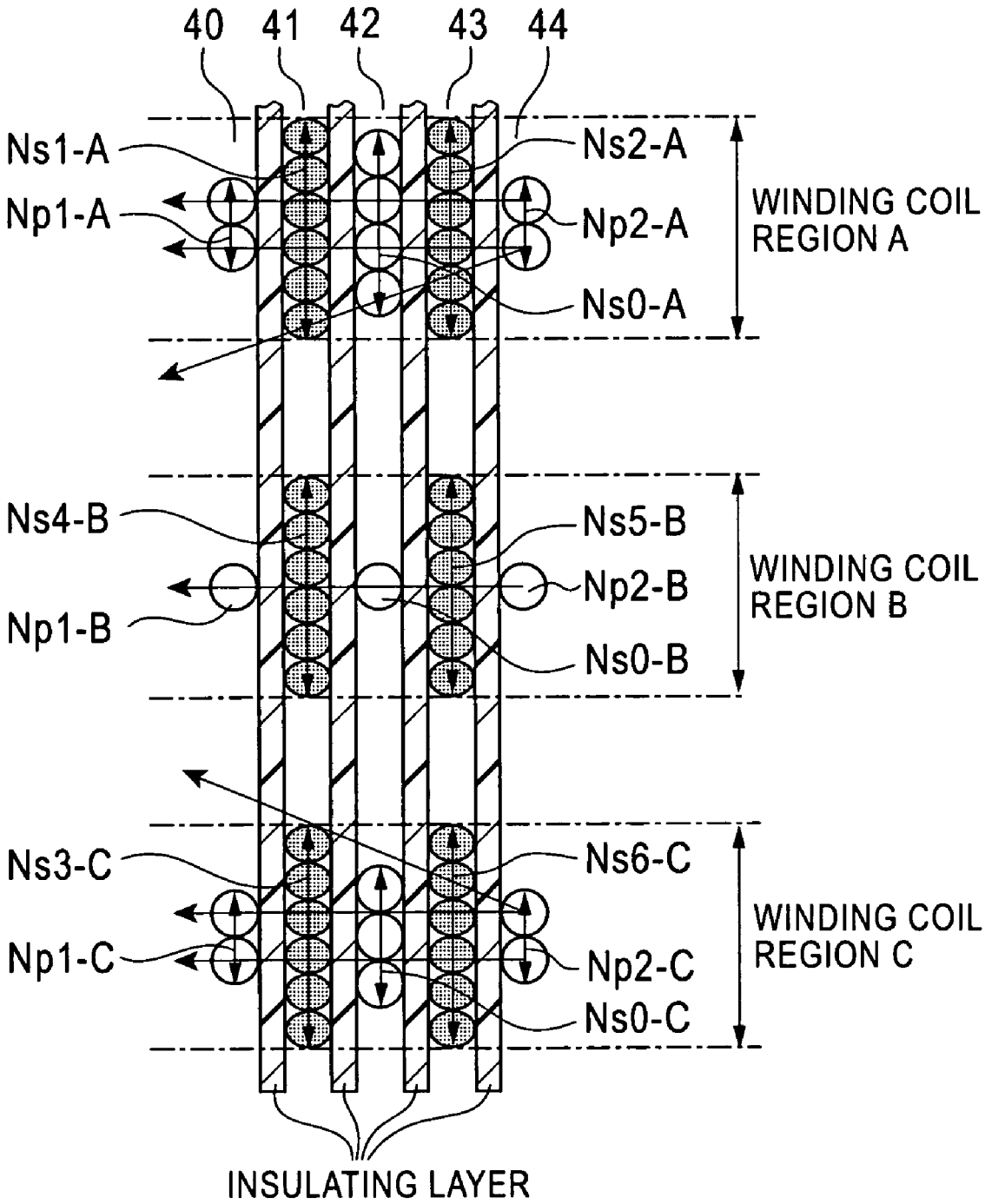
FIG. 6 is a schematic view illustrating coil structures in a PCB transformer according to one embodiment of the present invention.

As shown in FIG. 6, in the coil structures of the transformer according to the present invention, the input windings are separately wound within winding regions A, B and C spaced from each other and the output winding of each channel is also wound as a single coil within each winding region. That is, a magnetic flux produced by three input coils Np1-A, Ns0-A and Np2-A in the winding region A passes through output coils Ns1-A and Ns2-A in the winding region A. Further, one part of the magnetic flux passes through output coils Ns4-B and Ns5-B in the winding region B. Also, a magnetic flux produced by three input coils Np1-C, Ns0-C and Np2-C in the winding region C passes through output coils Ns3-C and Ns6-C in the winding region C and the one part passes through output coils Ns4-B and Ns5-B in the winding region B. The output coils Ns4-B and Ns5-B in the winding region B receives the influence of a magnetic flux from not only the input coils Np1-B, Ns0-B and Np2-B in the winding region B but also the winding regions A and B. When the three input coils Np1-B, Ns0-B and Np2-B in the winding region B have a fewer number of turns than the input coils Np1-A, Ns0-A and Np2-A in the winding region A, and less turns than the input coils Np1-C, Ns0-C and Np2-C in the winding region C, the magnetic flux produced in the three input coils in the winding region B is weaker than the magnetic flux produced in other winding regions.

Thus, the magnetic flux passing through output coils Ns1-A, Ns2-A, Ns4-B, Ns5-B, Ns3-C and Ns6-C can be kept approximately uniform. The fluctuation of output voltage in output channels can be suppressed by controlling a magnetic coupling degree in a coil of each output channel.

According to the present invention, the influence of magnetic flux from each winding region can be independently calculated since winding regions are wholly divided. It is, therefore, easy to design input coils, such as the number of turns, for making the magnetic flux passing through a coil of each output channel uniform.

This application is based on a Japanese patent application No. 2005-240847 which is incorporated herein by reference.

What is claimed is:

1. A printed circuit board transformer having plural output channels, comprising:

a core having a core axis;

a first layer including windings for input lines separately wound around said core as plural input coils spaced from each other along said core axis; and a second layer including windings for output lines corresponding to output channels separately wound on said first layer as plural output coils spaced from each other along said core axis;

wherein one of said input coils and one of said output coils are disposed in one of a plurality of winding regions defined along said core axis, and in each of said plurality of winding regions one coil having a narrower width of said input coil or said output coil is disposed within a width of another coil along said core axis.

2. The PCB transformer according to claim 1, wherein said input coil and said output coil in said winding regions are located so as to have the same center positions along the coil width direction.

3. The PCB transformer according to claim 1, wherein turns of said windings for said output lines are arranged side by side with no space in high density along said core axis within each of said winding regions.

4. The PCB transformer according to claim 1, further comprising:

a third layer including a winding for a controlling input line separately wound on said second layer as plural coils spaced from each other along said core axis; and a fourth layer including a winding for an additional output line corresponding to an additional output channel separately wound on said third layer as plural coils spaced from each other along said core axis;

wherein one of said controlling input coils and one of said additional output coils are disposed in one of said winding regions, and in each winding region one coill having a narrower width in said controlling input coil or said additional output coil is disposed within a width of another coil along said core axis.

5. The PCB transformer according to claim 4, wherein in each winding region said controlling input coil and said additional output coil are located so as to have the same center positions along the coil width direction.

6. The PCB transformer according to claim 4, wherein said additional output coils are formed so that one turn in said output additional coil contacts a next turn along said core axis.

7. The PCB transformer according to claim 4, wherein in each winding region said input coil, said controlling output coil, said controlling input coil and said additional output coil are located so as to have the same center position along said core axis.

* * * * *